US009958163B2

(12) United States Patent
Numata et al.

(10) Patent No.: US 9,958,163 B2
(45) Date of Patent: May 1, 2018

(54) COOLING STRUCTURE FOR GAS TURBINE COMBUSTOR LINER

(71) Applicant: Mitsubishi Hitachi Power Systems, Ltd., Yokohama, Kanagawa (JP)

(72) Inventors: Shohei Numata, Yokohama (JP); Osami Yokota, Yokohama (JP); Tetsuma Tatsumi, Yokohama (JP); Akinori Hayashi, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 444 days.

(21) Appl. No.: 14/511,260

(22) Filed: Oct. 10, 2014

(65) Prior Publication Data

US 2015/0101336 A1 Apr. 16, 2015

(30) Foreign Application Priority Data

Oct. 10, 2013 (JP) ..... 2013-212435

(51) Int. Cl.
*F23R 3/16* (2006.01)
*F23R 3/44* (2006.01)
(Continued)

(52) U.S. Cl.
CPC ..... *F23R 3/44* (2013.01); *F23R 3/005* (2013.01); *F23R 3/16* (2013.01); *F23R 3/54* (2013.01); *F23R 2900/03045* (2013.01)

(58) Field of Classification Search
CPC .. F23R 3/002; F23R 2900/03045; F23R 3/44; F23R 3/54; F23R 3/005; F23R 3/16;
(Continued)

(56) References Cited

U.S. PATENT DOCUMENTS 4,362,500 A 12/1982 Eriksson et al.
4,567,730 A * 2/1986 Scott ..... F23R 3/007 60/752
(Continued)

FOREIGN PATENT DOCUMENTS

JP 6-221562 8/1994
JP 2000-320837 A 11/2000
JP 2001-280154 A 10/2001

OTHER PUBLICATIONS

Seven Ranges "Quality Reiteration in Metal Stamping", 2011.*
(Continued)

*Primary Examiner* — William H Rodriguez
*Assistant Examiner* — William Breazeal
(74) *Attorney, Agent, or Firm* — Crowell & Moring LLP

(57) ABSTRACT

A gas turbine combustor is provided in which product reliability and heat transfer promotion are compatible while suppressing an increase in pressure loss.
In a gas turbine combustor comprising a combustor liner, an outer tube provided around an outer periphery of the combustor liner, and an annular flow passage in which a cooling medium (cooling air) flows and which is formed between an outer surface of the combustor liner and an inner surface of the outer tube, the outer tube includes an inner diameter reduced portion and a taper portion smoothly connecting the inner diameter reduced portion and an inner peripheral portion on an upstream side, and is provided at an inner surface of the taper portion with longitudinal vortex generating means generating a vortex that has a central rotation axis in a flowing direction of the cooling medium (cooling air).

9 Claims, 9 Drawing Sheets

(51) Int. Cl.
*F23R 3/00* (2006.01)
*F23R 3/54* (2006.01)

(58) Field of Classification Search
CPC .... F02C 3/145; F02C 7/12; F02C 7/18; F05D 2260/2212; F05D 2260/22141
See application file for complete search history.

(56) References Cited

U.S. PATENT DOCUMENTS

| | | | | |
|---|---|---|---|---|
| 5,058,837 | A * | 10/1991 | Wheeler | B64C 23/06 244/198 |
| 5,426,943 | A | 6/1995 | Althaus et al. | |
| 2005/0044857 | A1 | 3/2005 | Glezer et al. | |
| 2006/0042255 | A1 | 3/2006 | Bunker et al. | |
| 2009/0019854 | A1* | 1/2009 | Simons | F23R 3/002 60/738 |
| 2011/0108257 | A1* | 5/2011 | Miyake | F01D 25/12 165/168 |
| 2013/0333388 | A1 | 12/2013 | Polisetty et al. | |

OTHER PUBLICATIONS

Custom Manufacturing "Metal Forming of Hastelloy Burner Cans for a Military Application" Aug. 2013.*
Extended European Search Report dated Feb. 10, 2015 (four (4) pages).

* cited by examiner

COOLING STRUCTURE FOR GAS TURBINE COMBUSTOR LINER

CLAIM OF PRIORITY

The present application claims priority from Japanese Patent application serial no. 2013-212435, filed on Oct. 10, 2013, the content of which is hereby incorporated by reference into this application.

FIELD OF THE INVENTION

The present invention relates to a cooling structure for a gas turbine combustor liner.

BACKGROUND OF THE INVENTION

For combustor liners, turbine wings, heat exchangers, fins, boilers, heating furnaces, etc. of gas turbines and the like, with respect to promotion of heat transfer between fluid and solids in cooling, heating, heat exchanging, etc., various structures have been devised based on specifications required for the respective equipment.

For example, in combustors of gas turbines for electric power generation or the like, it is demanded to maintain required cooling-performance with low pressure loss level, which does not allow gas turbine efficiency to be deteriorated, and to maintain the reliability of structural strength. Moreover, from the viewpoint of consideration to environmental problems, it is demanded to reduce a discharge amount of nitrogen oxide (NOx) generated in the combustors. The cause of the generation of NOx includes the fact that, at the time of combustion, oxygen and nitrogen in air are maintained at a very high temperature. In order to prevent this to reduce NOx, premix combustion in which fuel and air are mixed prior to combustion and the mixture is then combusted is employed, and it is realized to combust the mixture in a state where the mixture ratio of fuel and air (a fuel-air ratio) is lower than a theoretical mixture ratio.

As a heat transfer device (a heat transfer structure) of a gas turbine combustor in which the above mentioned matter is taken into consideration, a structure provided with a combustor liner which is formed by axially connecting a plurality of cylindrical materials formed by cylindrically rolling up substantially rectangular-shaped plate materials is described in Japanese Patent Application Laid-Open No. 2001-280154 (Patent Literature 1). Each cylindrical material in the combustor liner is overlapped on and connected to adjacent cylindrical materials. The overlapped portions are coupled by welding or brazing.

Moreover, at one end of each cylindrical material (a downstream side in a flowing direction of compressed air from a compressor), a plurality of protrusions (longitudinal vortex generators) which are formed by press machining or the like are circumferentially arranged. The longitudinal vortex generators generate a longitudinal vortex which has a central rotation axis in a flowing direction of a cooling medium (cooling air) (compressed air). By the longitudinal vortex, the cooling medium (cooling air) in a flow passage is agitated. Moreover, on an outer peripheral surface of the combustor liner, ribs (turbulators) for destroying a boundary layer which is generated in the cooling medium (cooling air) agitated by the longitudinal vortex generators are provided.

Moreover, as a heat transfer structure of a gas turbine combustor which has a different structure, a structure is described in Japanese Patent Application Laid-Open No. Hei. 6-221562 (Patent Literature 2), in which an inner diameter of an outer tube provided for forming a flow passage for a cooling medium (cooling air) on the outside of a liner is gradually reduced. In the structure described in this literature, a heat transfer coefficient is improved by reducing the cooling medium flow passage between the combustor liner and the outer tube to increase a flow velocity of the cooling medium and by increasing surface roughness of a liner surface.

Moreover, as a heat transfer structure of a gas turbine combustor which has a different structure, a structure is described in Japanese Patent Application Laid-Open No. 2000-320837 (Patent Literature 3). This literature describes "by providing guide fins on an outer periphery side of a liner and on an inner periphery side of an outer tube, a flow velocity is increased to realize improvement in heat transfer effect".

While the heat transfer device disclosed in the patent literature 1 is superior to conventional heat transfer devices in cooling performance, structural strength, low NOx property, and the like, there remains room for improvement in its structure from the viewpoint of the simplification of manufacturing process and long-life property.

For example, while the combustor liner is formed by axially coupling the plurality of cylindrical materials, the respective cylindrical materials are weld-coupled at the overlapped portions. Such welded portions may become the cause of generation of cracks and may not endure long usage as compared to a case where the welding is not employed (namely, in a case where the combustor liner is formed from a single cylindrical material). Moreover, the fact that the provision of a great number of welded portions increases the workload of the combustor liner to result in an increase in the manufacturing cost of the combustor liner can be pointed out. This fact becomes more remarkable in the case of employment of welding for the mounting of the ribs that are the turbulators.

Moreover, in the case of the employment of the welding, the respective cylindrical materials may be subjected to thermal deformation. In the case of occurrence of the thermal deformation, an incorporating property of the combustor liner into other cylindrical members (for example, a disk plate, to which a combustion nozzle and a premix nozzle are mounted, a transition piece (a tail cylinder), etc.) is lowered and the labor for causing the combustor liner to be again formed into a circular shape is required, whereby the fabrication process of the combustor may be complicated. Moreover, the fact that because the overlapped portions of the respective cylindrical materials forming the combustor liner have double structures and become thicker than other portions, the heat transfer property (cooling property) of the overlapped portions is lowered as compared to that of the other portions can be also pointed out.

Moreover, the heat transfer device disclosed in the patent literature 2 has a simple structure on the combustor liner side as compared to the heat transfer device disclosed in the patent literature 1, so that it is considered to be superior in the simplification of the fabrication process and the long-life property of the structure, but it realizes the heat transfer promotion only by the increase in the flow velocity and the surface roughness, so that the pressure loss may become excessively high in order to obtain a large heat transfer promoting effect.

Moreover, although the heat transfer device disclosed in the patent literature 3 has the structure in which the guide fins are installed only on the inner periphery side of the outer tube and which is superior in the simplifying property and the long-life property, the action in the heat transfer device which contributes to the heat transfer promoting is only the increase in the flow velocity and, like the heat transfer device described in the patent literature 2, the pressure loss may become excessively high in order to obtain the large heat transfer promoting effect.

The object of the present invention is to provide a heat transfer device which can promote heat transfer while suppressing an increase in pressure loss and is superior in a simplifying property of a fabrication process and a long-life property.

SUMMARY OF THE INVENTION

In order to attain the above-mentioned object, the present invention is characterized by a gas turbine combustor that allows a cooling medium (cooling air) to flow between a combustor liner and an outer tube, wherein the outer tube is provided with an inner diameter reduced portion and longitudinal vortex generating means that generate a longitudinal vortex is provided on an inner surface of the outer tube on an upstream side relative to the inner diameter reduced portion.

In accordance with the present invention, it is possible to improve the heat transfer promoting effect of the combustor liner, while obtaining the simplification of the fabrication process, attaining life prolongation, and suppressing the increase of the pressure loss.

DETAILED DESCRIPTION OF THE PREFERRED EMBODIMENTS

Figure 1:
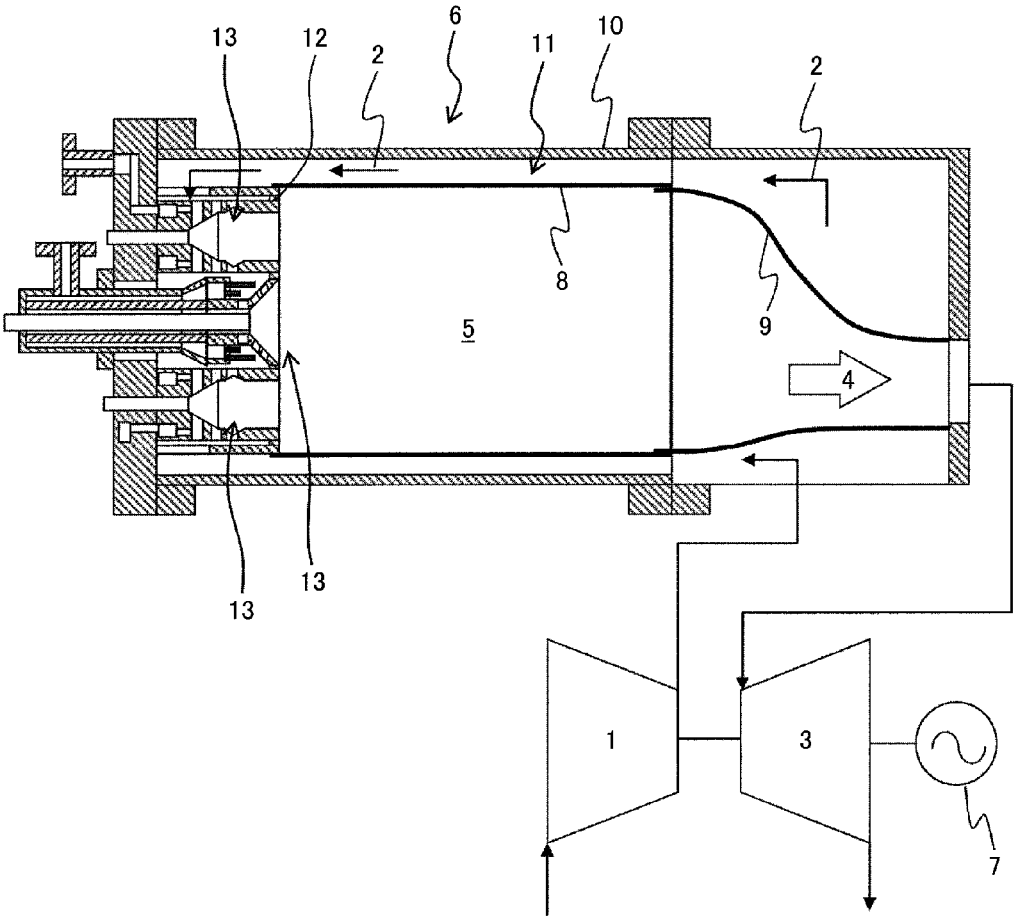
FIG. 1 is a schematic structure view of a gas turbine plant.

Respective embodiments of the present invention which will be explained hereinafter relate to gas turbine combustors provided with heat transfer devices and, particularly, to gas turbine combustors which are provided with devices promoting heat transfer between fluid and members by forced convection, namely, heat transfer devices which cause heat transfer media to flow along the surfaces of the members and are adapted to carry out heat exchange between the members and the heat transfer media.

In the forced convection heat transfer, it is necessary for improvement in efficiency to suppress an increase in pressure loss with respect to heat transfer promotion. For example, for improvement in the efficiency of a gas turbine, it is necessary to increase combustion gas temperature. While it is demanded to enhance liner-cooling according to this increase, it is necessary to avoid the increase of the pressure loss in more cooling promotion processes. In such a situation, in impinging jet cooling (impinging cooling), the pressure loss may be increased according to an increase in a jet flow velocity. Moreover, in fin-cooling, the pressure loss tends to become larger according to an increase in fins. While the increase of the pressure loss is relatively small in the turbulence promotion by the ribs, significant improvement in cooling performance cannot be expected even if rib intervals are narrowed, so that there is a limit to the cooling promotion by the increase in the ribs.

Therefore, in order to realize the improvement of the heat transfer performance while suppressing the increase of the pressure loss, there have been proposed a plurality of combustor liners provided with heat transfer devices. One of the specific examples is to improve the cooling performance with less pressure loss by providing plate-shaped longitudinal-vortex generating means and rib-shaped turbulence promoting means on an outer surface of a combustor liner like that described in the patent literature 1. The fundamental structure of such a technology has the heat transfer device installed on the surface of the combustor liner whose temperature becomes high, so that the number of components, to be added to the combustor liner surface, and welded portions is increased and many costs and much time are required for securement of reliability of a product from the viewpoint of an increase in manufacturing cost and thermal strength.

Next, in the patent literature 3, a specific example is described in which the guide fins are provided on the outer periphery side of the combustor liner and on the inner periphery side of the outer tube. The fundamental structure of the combustor which is described in the patent literature 3 resides in that a cross-sectional area of an annular flow passage which is formed by the combustor liner and the outer tube is narrowed (reduced) by the installment of the guide fins, to thereby increase the flow velocity of passing air (cooling medium (cooling air)) to realize improvement in a heat transfer effect. However, the increase of the flow velocity increases the pressure loss and contributes to deterioration in the efficiency of the entire gas turbine.

Therefore, considering these situations, apparatuses are provided which suppress the increase of the pressure loss while improving the reliability of products with the provision of certain heat transfer devices. For example, in a gas turbine combustor which is one of such apparatuses, by the provision of the longitudinal vortex generating means which are configured to further improve the heat transfer performance (cooling effect), it is possible to maintain required cooling performance with pressure loss that allows the deterioration of the gas turbine efficiency to be minimized, improve the reliability of the structural strength, and increase premix combustion air to realize NOx reduction.

As a more specific example, in a combustor for a gas turbine which is provided with a heat transfer device, a combustor liner on an inner periphery side and an outer tube on an outer periphery side which form an annular flow passage for a cooling medium (cooling air) are provided, an inner diameter of the outer tube is configured to be reduced through a taper portion, and longitudinal vortex generating means that generate a vortex (a longitudinal vortex) having a central rotation axis in a flowing direction of a cooling medium (cooling air) are provided on an inner surface of the outer tube on an upstream side relative to the inner diameter reduced portion.

Moreover, as a different specific example, in a combustor liner on an inner periphery side and an outer tube on an outer periphery side having an inner diameter reduced portion which form an annular flow passage, longitudinal vortex generating means that generate a vortex (a longitudinal vortex) having a central rotation axis in a flowing direction of a cooling medium (cooling air) are provided on an inner surface of the outer tube on an upstream side relative to the inner diameter reduced portion, and turbulence promoting means which destroy a boundary layer produced in the cooling medium (cooling air) are provided on an outer surface of the combustor liner.

Moreover, as a different specific example, in a combustor liner on an inner periphery side and an outer tube on an outer periphery having an inner diameter reduced portion which form an annular flow passage, longitudinal vortex generating means that generate a vortex (a longitudinal vortex) having a central rotation axis in a flowing direction of a cooling medium (cooling air) are provided on an inner surface of a taper portion on an upstream side relative to an inner diameter reduced portion of the outer tube.

Moreover, as a different specific example, in an outer tube on an outer periphery side which forms an annular flow passage together with a combustor liner on an inner periphery side, an inner diameter of the outer tube is configured to be reduced at a plurality of portions through taper portions, and longitudinal vortex generating means that generate a vortex (a longitudinal vortex) having a central rotation axis in a flowing direction of a cooling medium (cooling air) are provided on inner surfaces of respective taper portion.

According to such structures, by the provision of the heat transfer devices on the inner surface of the outer tubes, it is possible to suppress the increase of the pressure loss while improving product reliability. Moreover, by a reduction in components to be mounted to the combustor liner, the number of welded portions can be reduced, so that improvement of the reliability of the combustor liner and life prolongation according to this are realized. Moreover, the reduction in the number of welded portions can allow combustor liner deformation to be suppressed. In addition, the longitudinal vortex generating means are provided on the outer tube inner surface, whereby the degree of freedom in mounting the turbulence promoting means to be installed on the combustor liner outer surface is increased and improvement of a local cooling effect is realized.

Namely, it is possible to effectively exert an effect of the longitudinal vortex, generated by the longitudinal vortex generating means provided on the outer tube side, on the liner side, while simplifying the combustor liner structure, so that it is possible to improve the heat transfer promoting effect of the combustor liner, while obtaining the simplification of the fabrication process, attaining life prolongation, and suppressing the increase of the pressure loss.

Embodiments of the present invention will be explained hereinafter with reference to the drawings. Incidentally, although a heat transfer device according to the present invention is widely applied, a gas turbine combustor which is a high temperature zone and in which a flow is a turbulence field is now explained as one example.

FIG. 1 shows a cross-sectional view of a gas turbine combustor and is a schematic structure view of a gas turbine plant (gas turbine electricity generation equipment) provided with this gas turbine combustor. The gas turbine plant shown in this Figure comprises a compressor 1 compressing air to generate high pressure combustion air (compressed air), a combustor 6 generating high temperature combustion gas 4 by mixing fuel and combustion air 2 introduced from the compressor 1 and then combusting the mixture, a turbine 3 obtaining shaft-driving force from energy of the combustion gas 4 generated in the combustor 6, and an electricity generator 7 driven by the turbine 3 to carry out electricity generation. Incidentally, the rotation shafts of the compressor 1, turbine 3 and electricity generator 7 which are shown are mechanically connected.

The combustor 6 includes an outer tube 10, a cylindrical combustor liner (an inner tube) 8 arranged inside the outer tube 10 through a spacing and defining a combustion chamber 5, and a transition piece (a tail tube) 9 connected to an opening of the combustor liner 8 on a turbine 3 side and introducing the combustion gas 4, generated in the combustion chamber 5, into the turbine 3. Between the outer tube 10 and the combustor liner 8, an annular passage 11 through which the combustion air (a cooling medium (cooling air)) 2 supplied from the compressor 1 passes is formed. Moreover, the combustor 6 includes a substantially disk-shaped plate 12 entirely closing an end of the combustor liner 8 on an upstream side of a flowing direction of the combustion gas and arranged substantially perpendicular to a central shaft of the combustor liner 8 in such a manner that a one side surface thereof faces the combustion chamber 5, and a plurality of burners 13 arranged on the plate 12.

Figure 9:
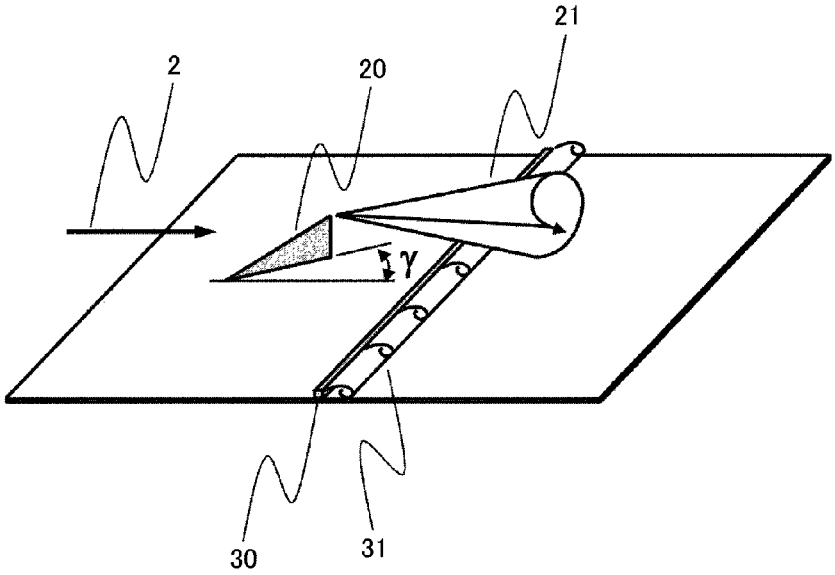
FIG. 9 is a conceptual view showing a flow which is produced by the longitudinal vortex generating means and turbulence promoting means.

In FIG. 9, stream lines of longitudinal vortex generating means 20 and turbulence promoting means 30 of each embodiment, and the concept of heat transfer promotion are illustrated. The longitudinal vortex generating means 20 are formed by a plate-shaped protrusion which protrudes from a cooling medium (cooling air) flowing side surface. The protrusion has a constant elevation angle $\gamma$ with respect to a primary flow direction of the cooling medium (cooling air), so that a longitudinal vortex having a rotation axis in a flowing direction is generated and flows toward a downstream side while significantly agitating the cooling medium (cooling air) (the air 2) in the flow passage.

The action of the cooling medium (cooling air) flowing while being significantly agitated is considered in a case where the present invention is applied to a combustor for a gas turbine as an example. For example, in the case where the longitudinal vortex generating means 20 are provided in the annular flow passage which is formed by the combustor liner and the outer tube, the air that is the cooling medium (cooling air) flows while being significantly agitated, warmed air on the combustor liner side and cold air on the outer tube side are exchanged by the longitudinal vortex. As a result, low temperature cooling medium (cooling air) is always supplied to the combustor liner surface, so that convective cooling of the combustor liner surface can be efficiently carried out.

Moreover, a longitudinal axis direction of the turbulence promoting means 30 provided on the combustor liner surface is intersected with respect to the primary flowing direction of the cooling medium (cooling air), whereby a separation vortex is generated in the neighborhood of a liner wall surface. This separation vortex has a significant effect of destroying a boundary layer of the cooling medium (cooling air) that is generated in the neighborhood of the wall surface, so that it is possible to obtain a significant cooling promoting effect by using the turbulence promoting means together with the longitudinal vortex generating means. The height h of the turbulence promoting means 30 is determined by considering a distance in which the separation vortex re-adheres to the combustor liner.

In respect of respective embodiments, the description of entire structures of gas turbines and the description of detailed operations of the combustors including combustion nozzles are omitted. They are requested to refer to the contents of the patent literature 1. Moreover, the outer tube is a cylindrical-shaped structure that is provided around the outer periphery side of the combustor liner in order to control the flow velocity and drift of the air supplied to the combustor.

First Embodiment

Figure 2:
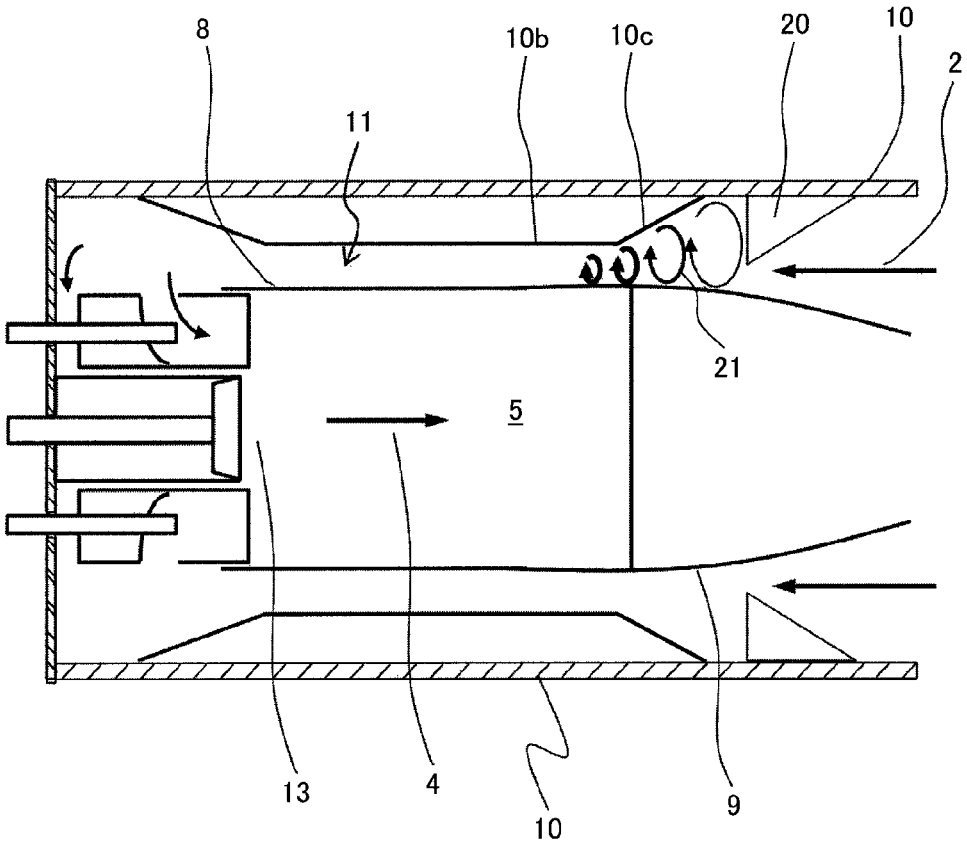
FIG. 2 is a sectional view of a gas turbine combustor according to a first embodiment of the present invention.

FIG. 2 is a cross-sectional view of a gas turbine combustor according to a first embodiment of the present invention. Identical reference signs are assigned to portions identical to those in the prior Figure and the description of them is omitted (in the following Figures, the same shall apply).

In the gas turbine combustor shown in this Figure, a combustor liner 8 and an outer tube 10 define a double-cylinder structure of a substantially concentric circular shape, the diameter of the outer tube is made larger than that of the combustor liner to thereby form an annular flow passage in which air 2 that is a cooling medium (cooling air) flows.

In this embodiment, the outer tube 10 includes an inner diameter reduced portion 10*b* reduced in diameter relative to an inner peripheral portion on an upstream side, and a taper portion 10*c* smoothly connecting the inner diameter reduced portion 10*b* and the inner peripheral portion on the upstream side, and longitudinal vortex generating means 20 that generate a longitudinal vortex 21 are provided on an inner surface on the upstream side relative to the inner diameter reduced portion 10*b*. An installing method of the longitudinal vortex generating means is to prepare a pair of longitudinal vortex generating means 20 having elevation angles allowing generated vortexes to have mutually opposite rotational directions, and to cause a plurality of pairs of longitudinal vortex generating means to be arranged at equal intervals in a circumferential direction of the outer tube inside.

In such a structure, when the combustion air 2 that flows in the annular flow passage 11 passes through the longitudinal vortex generating means 20, a secondary flow (longitudinal vortex) 21 is generated. The longitudinal vortex 21 generated at this time passes through the taper portion 10*c* on the downstream side in accompany with a primary flow, but is pushed against a combustor liner 8 side at this time. Moreover, a diameter of the vortex is reduced according to the reduction in the flow passage, so that the strength of the vortex becomes large. Thereby, an impinging effect by the strong longitudinal vortex and an agitating effect between the combustor liner and the outer tube are exerted on a liner surface that is a cooling target, and it is possible to promote the heat transfer of a liner wall surface while suppressing an increase in pressure loss.

Moreover, the radial heights of the longitudinal vortex generating means 20 are made to be high at the same level as the height of the annular flow passage 11 formed by the combustor liner 8 and the outer tube 10, thereby making it possible to obtain an effect of agitating the cooling medium (cooling air) in the entire annular flow passage and an effect of affecting a temperature boundary layer on the combustor liner side, and to further promote the heat transfer of the combustor liner wall surface. Incidentally, the heights of the longitudinal vortex generating means 20 are not necessarily equal to the height of the annular flow passage 11, and considering, for example, a thermal elongation difference between the combustor liner 8 and the outer tube 10 and strength of the combustor liner and outer tube, the heights of the longitudinal vortex generating means 20 may be set so as to be somewhat reduced relative to the height of the annular flow passage 11.

Figure 3:
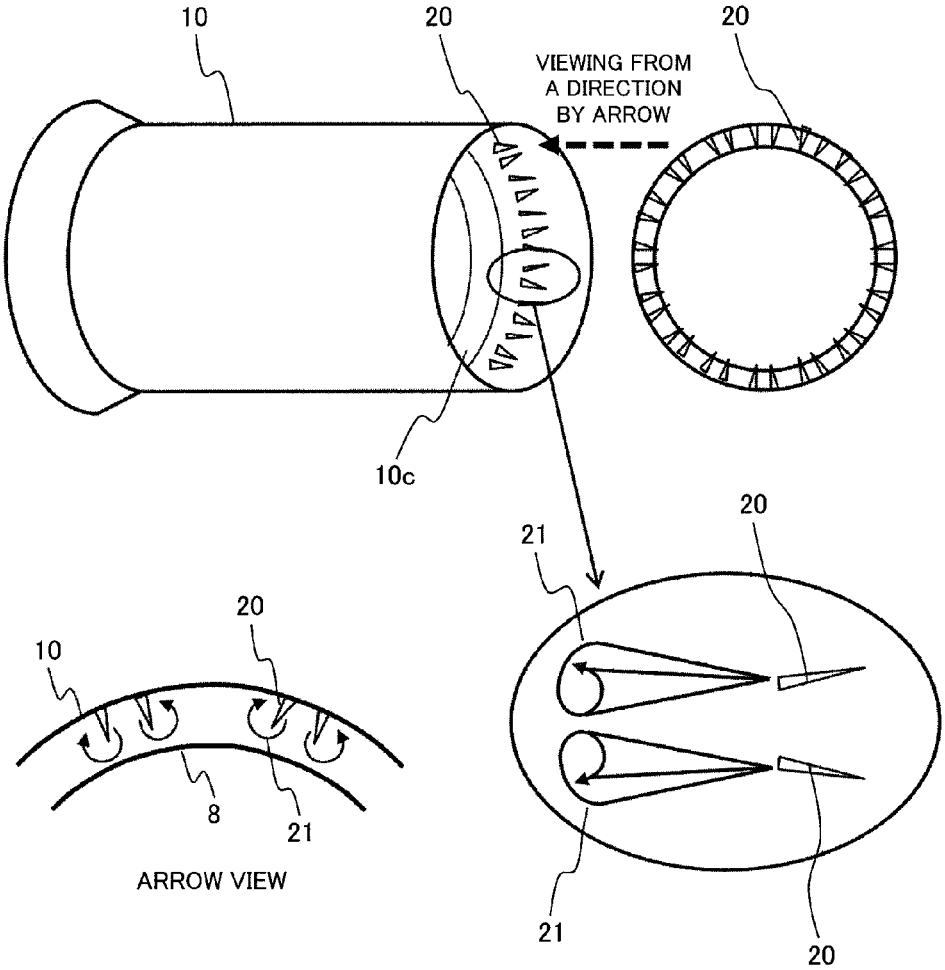
FIG. 3 is a view illustrating an example of an outer tube structure provided with longitudinal vortex generating means according to the first embodiment of the present invention.

FIG. 3 shows a specific example of this embodiment in which the longitudinal vortex generating means 20 are installed on the inner surface of the outer tube 10. In this Figure, each longitudinal vortex generating means 20 that is fixed on the inner surface of the outer tube 10 by welding or spot-welding is shown. Moreover, as shown in an enlarged detailed illustration in FIG. 3, the longitudinal vortex generating means include triangular-shaped ribs which are arranged at elevation angles with respect to the flowing direction of the cooling medium (cooling air). Adjacent longitudinal vortex generating means are configured to be paired and installed at elevation angles that allow the generated vortexes to have mutually opposite rotational directions.

The longitudinal vortex generating means 20 that cause the generated vortexes to have the mutually opposite rotational directions in this way are arranged in pairs, whereby the longitudinal vortexes having the mutually opposite rotational directions are mutually interacted, so that it is possible to efficiently generate and maintain the vortexes. Therefore, it is possible to carry out sufficient cooling with less pressure loss and suppress the increase in the pressure loss while improving the reliability of the product.

Figure 10:
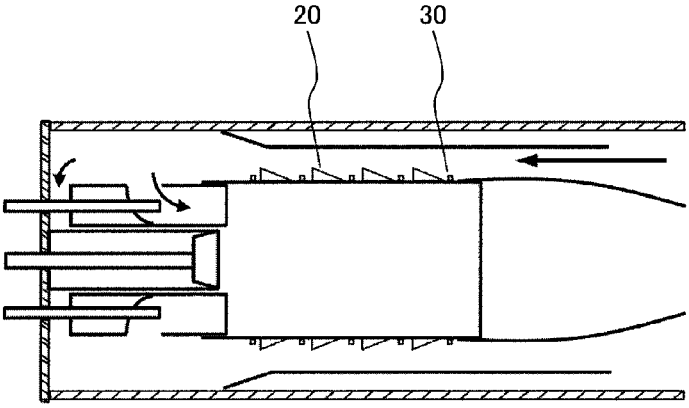
FIG. 10 is a sectional view of a gas turbine combustor provided with a heat transfer device according to a comparative example.

A gas turbine combustor that is provided with a heat transfer device according to a comparative example is shown in FIG. 10. The heat transfer device according to the comparative example is characterized in that an outer surface of a combustor liner is provided with both of longitudinal vortex generating means and turbulence promoting means. The heat transfer device is configured to be installed on the combustor liner side which becomes high temperature.

Contrary to this, the advantage of causing the longitudinal vortex generating means 20 to be installed on the inner surface of the outer tube 10 as in this embodiment lies in that it is possible to suppress the increase of the pressure loss while improving the reliability of the product serving as a combustor for a gas turbine that is provided with a heat transfer device, because thermal fatigue of the welded portions of the longitudinal vortex generating means 20 is reduced by causing the longitudinal vortex generating means to be installed on the outer tube 10 that is a low temperature member side. Moreover, by a reduction in the number of components to be mounted to the combustor liner, the number of the welded portions can be reduced, so that it is possible to realize a reduction in costs and suppress combustor liner deformation. Namely, the outer tube is different from the combustor liner and is a component for forming the annular flow passage in which the cooling medium (cooling air) flows, so that it is always brought to a low temperature state and is not required to be cooled. Therefore, material of which the outer tube is formed may be inexpensive material such as carbon steel.

Moreover, by causing the longitudinal vortex generating means to be installed on the outer tube side, it is possible to continuously use the longitudinal vortex generating means, that are the heat transfer devices, as they are, even if the combustor liner is exchanged, and the longitudinal vortex generating means are not required to be exchanged. The main operation of the combustor liner relative to the outer tube lies in partition between the high temperature combustion gas 4 and the air 2 that is the cooling medium (cooling air), so that the combustor liner is always required to be cooled below a fixed temperature. If deformation of the combustor liner by welding occurs, it is conceivable that the balance of the air for cooling is locally lost and burnout of the combustor liner occurs due to a lack of an amount of the cooling air. However, according to this embodiment, it is possible to reduce the number of the welded portions by reducing the components to be mounted to the combustor liner, so that it is possible to suppress the deformation of the combustor liner and improve the reliability of the product.

In addition, the patent literature 3 describes "the effect of speeding up a flow in an annular flow passage in the neighborhood of a combustion tube only by the guide fines, installed on an outer tube of a combustion tube, to improve heat transfer coefficient". Namely, the guide fins are discontinuously arranged, at angles of 30-60 degrees to a primary flow direction, on the inner surface of the outer tube, whereby the cross-sectional area of the annular flow passage is narrowed (reduced) and the flow velocity of passing air (a cooling medium (cooling air)) are increased to realize improvement in the heat transfer effect (cooling effect). However, the increase of the flow velocity leads to the increase of pressure loss.

Moreover, focusing on the generated vortexes, the structure described in the patent literature 3, in which the discontinuous guide fines are provided in a peripheral direction of the outer surface of the combustor liner is a structure which generates transverse vortexes (horizontal vortexes) on the surface of the combustor liner when the cooling medium (cooling air) (air) passes through spaces between the both ends of the guide fins. By the transverse vortexes (the horizontal vortexes), it is possible to destroy a boundary layer of the combustor liner surface, so that the cooling effect is locally improved. However, the transverse vortexes (the horizontal vortexes) increase in temperature as they flow in a downstream direction, so that a heat transfer property (cooling performance) is gradually reduced.

Contrary to this, in this embodiment, the angles of the longitudinal vortex means 20 relative to the primary flow direction are acute angles of 10-20 degrees, so that it is possible to suppress the increase of the pressure loss with a minimal reduction in the cross-sectional area of the annular flow passage.

Second Embodiment

Figure 4:
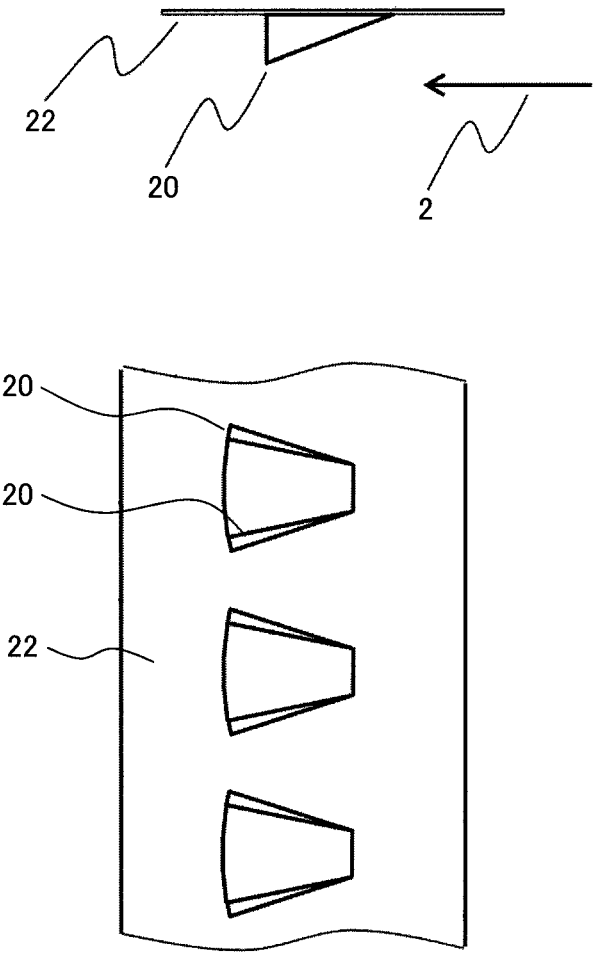
FIG. 4 is a top plane view of longitudinal vortex generating means according to a second embodiment of the present invention, as developed to a planar form.

FIG. 4 is a view showing longitudinal vortex generating means which that a heat transfer device of a combustor according to a second embodiment includes. This embodiment is fabricated by causing the longitudinal vortex generating means 20, which generate longitudinal vortexes having rotational axes in the flowing direction of the cooling medium (cooling air), to be formed on a sheet-shaped material 22 by integral molding, bending the sheet-shaped material into a cylindrical shape, thereafter, inserting it into the outer tube 10 inner surface, and fixing it to the outer tube by spot-welding.

Now, the manufacturing method of the heat transfer device including the longitudinal vortex generating means 20 is briefly explained. First of all, the longitudinal vortex generating means 20 which have fixed elevation angles with respect to the flow direction are mold-processed on the surface of the sheet-shaped material 22 by a press machine or the like. Then, the material 22 having the molded longitudinal vortex generating means 20 is bent into a cylindrical shape, inserted inside the outer tube 10 to install it on the outer tube. The longitudinal vortex generating means are molded at the elevation angles which allow the rotational directions of the vortexes generated by adjacent longitudinal vortex generating means to become opposite directions.

According to the gas turbine combustor having the longitudinal vortex generating means 20 formed in such a manufacturing method, by preparing a mold, it is possible to process the heat transfer device having the longitudinal vortex generating means 20 easily formed on the sheet-shaped member 22 by the integral mold, and to realize a reduction in costs by the simplification of the manufacturing method.

Third Embodiment

Figure 5:
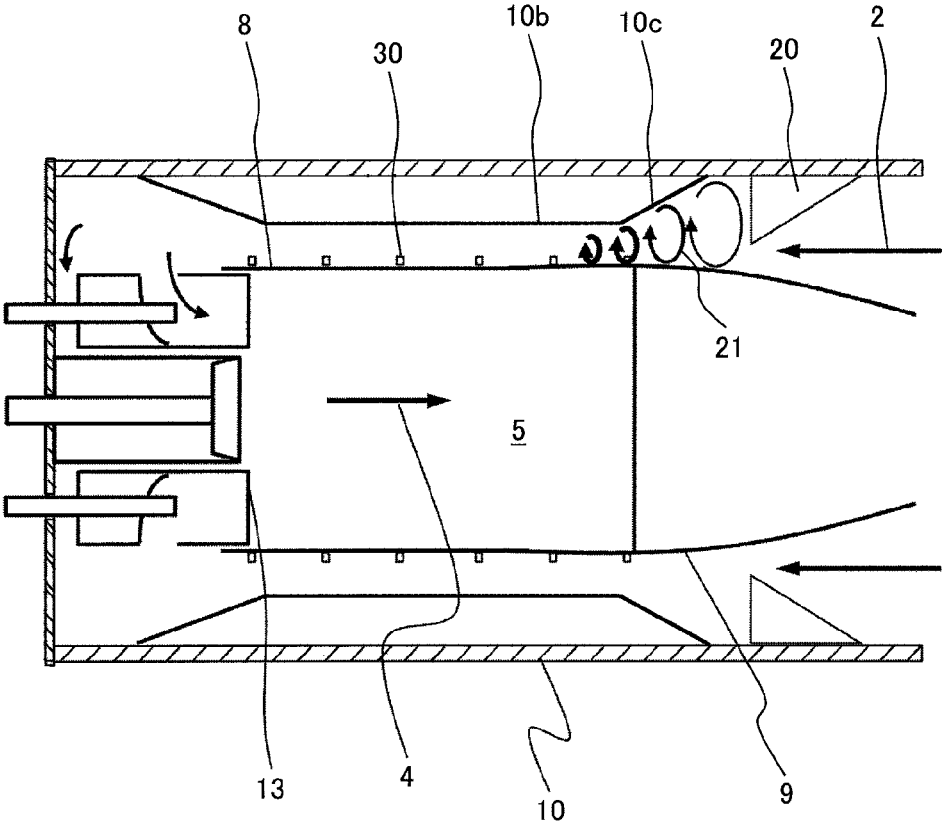
FIG. 5 is a sectional view of a gas turbine combustor according to a third embodiment of the present invention.

FIG. 5 is a view showing the structure of a combustor provided with a heat transfer device according to a third embodiment. Specifically, turbulence promoting means 30 which destroys the boundary layer produced in the cooling medium (cooling air) is arranged in a plurality of numbers on the outer surface of the combustor liner 8 in an axial direction of the combustor liner 8. By the operation of the turbulence promoting means 30 installed so as to intersect the flowing direction of the cooling medium (cooling air) in this way, a separation vortex is produced in the neighborhood of the wall surface of the combustor liner 8. This vortex does not have the effect of significantly agitating the cooling medium (cooling air) in the entire flow passage as in the longitudinal vortex generating means 20, but has a great effect of destroying the boundary layer in the neighborhood of the wall surface of the combustor liner, so that the cooling promoting effect is synergistically increased by using the turbulence promoting means together with the longitudinal vortex generating means 20 provided on the inner surface of the outer tube.

This is because the separation vortex which is produced by the turbulence promoting means 30 destroys the boundary layer in the neighborhood of the combustor liner wall surface, whereby cryogenic air which is conveyed from the side of the outer tube 10 by the longitudinal vortex can be effectively used for the cooling of the combustor liner 8. Therefore, according to the structure of this embodiment in which both of the longitudinal vortex generating means 20 and the turbulence promoting means 30 provided on the outer surface of the combustor liner and destroying the boundary layer produced in the cooling medium (cooling air) are provided at the same time, it is possible to further improve the cooling efficiency, so that the effect of more significantly improving the reliability of a product and the effect of suppressing the increase of the pressure loss can be obtained.

Fourth Embodiment

Figure 6:
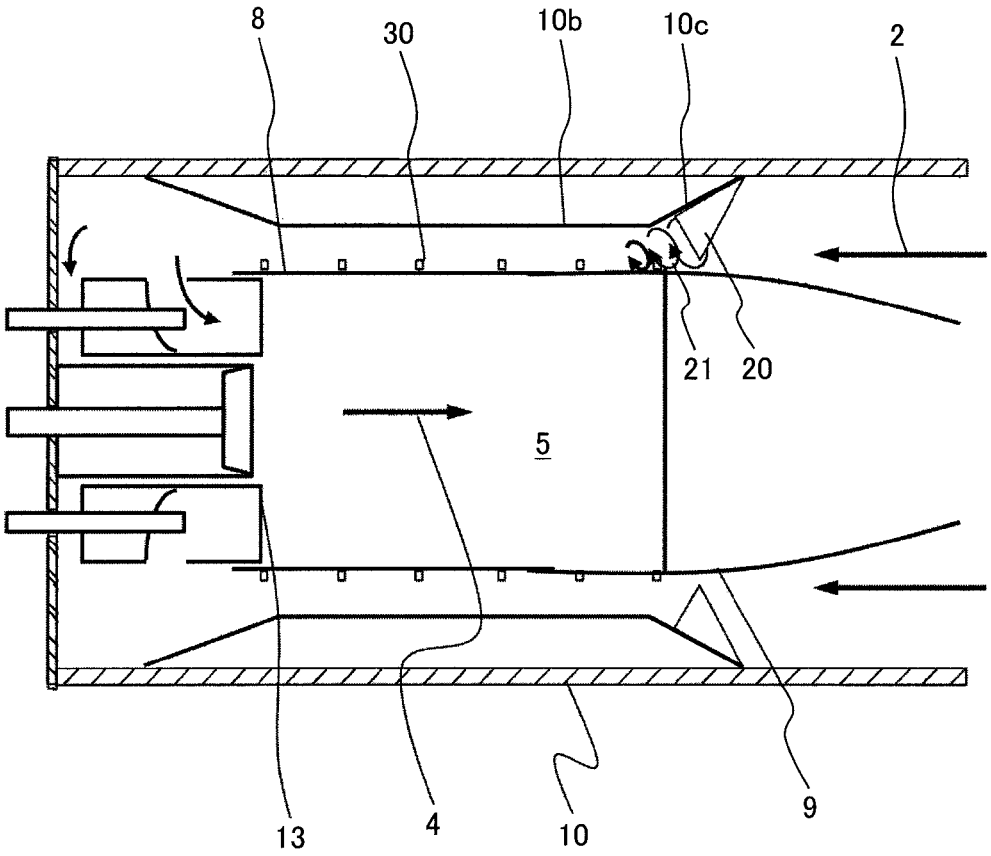
FIG. 6 is a sectional view of a gas turbine combustor according to a fourth embodiment of the present invention.

FIG. 6 is a view showing the structure of a combustor provided with a heat transfer device according to a fourth embodiment. Specifically, the outer tube 10 includes an inner diameter reduced portion 10*b* and a taper portion 10*c* and is provided with the longitudinal vortex generating means 20 on the taper portion 10*c* on the upstream side relative to the inner diameter reduced portion 10*c*. According to such a structure, the direction of travel of the longitudinal vortexes 21 generated by the longitudinal vortex generating means 20 is directed to the combustor liner side along the taper portion. Thereby, an agitating effect in a region more close to the combustor liner surface which is a cooling target is obtained and it is possible to promote the heat transfer of the combustor liner wall surface while suppressing the increase of the pressure loss. The sizes of the longitudinal vortex generating means 20 are made large to the extent that upper ends of the longitudinal vortex generating means extend to the outer surface of the combustor liner 8, whereby the effect of agitating the cooling medium (cooling air) in the entire annular flow passage and the effect of influencing on a temperature boundary layer on the combustor liner side can be obtained and it is possible to further promote the heat transfer of the liner wall surface.

Moreover, the turbulence promoting means 30 are installed on the outer surface of the combustor liner 8, whereby the cooling promoting effect is synergistically increased. This is because the separation vortex which is produced by the turbulence promoting means 30 destroys the boundary layer in the neighborhood of the combustor liner wall surface, whereby cryogenic air which is conveyed from the side of the outer tube 10 by the longitudinal vortex can be effectively used for the cooling of the combustor liner 8.

Therefore, according to the structure of this embodiment in which the longitudinal vortex generating means 20 on the taper portion 10*c* of the outer tube and the turbulence promoting means 30 on the outer surface of the combustor liner 8 are provided at the same time, the cooling efficiency can be more improved, so that the effect of more significantly improving the reliability of the product and the effect of suppressing the increase of the pressure loss can be obtained.

Fifth Embodiment

Figure 7:
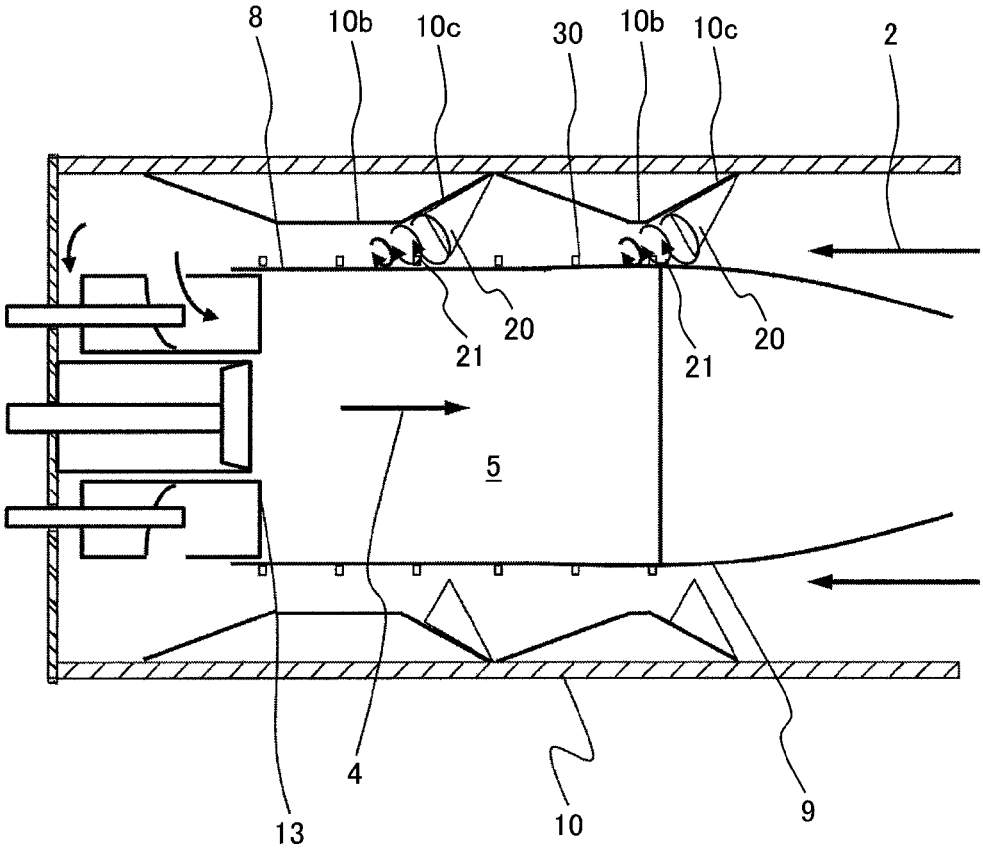
FIG. 7 is a sectional view of a gas turbine combustor according to a fifth embodiment of the present invention.

FIG. 7 is a view showing the structure of a combustor provided with a heat transfer device according to a fifth embodiment. Specifically, the outer tube 10 includes a plurality of inner diameter reduced portions 10*b* and a plurality of taper portions 10*c* corresponding in number to the inner diameter reduced portions 10*b*, and the longitudinal vortex generating means 20 are provided on the respective taper portions 10*c* on the upstream side of the inner diameter reduced portions. By this structure, the travel directions of the longitudinal vortexes 21 produced by the longitudinal vortex generating means 20 are oriented to the side of the combustor liner along the taper portions. Thereby, the agitating effect in the region more close to the combustor liner surface that is the cooling target is induced and it is possible to target a portion to be particularly required to be cooled (a local high temperature portion) to promote the heat transfer of the combustor liner wall surface, while suppressing the increase of the pressure loss.

Moreover, the turbulence promoting means 30 are installed on the outer surface of the combustor liner 8, whereby the cooling promoting effect is synergistically increased. This is because the separation vortex produced by the turbulence promoting means 30 destroys the boundary layer in the neighborhood of the combustor liner wall surface, whereby the cryogenic air conveyed from the side of the outer tube 10 by the longitudinal vortex can be effectively used for the cooling of the combustor liner 8.

Therefore, according to the structure of this embodiment in which the longitudinal vortex generating means 20 installed in multiple steps on the outer tube taper portions 10*c* and the turbulence promoting means 30 on the outer surface of the combustor liner 8 are provided at the same time, it is possible to more improve the cooling efficiency, so that the effect of remarkably improving the reliability of the product and the effect of suppressing the increase of the pressure loss can be obtained.

Sixth Embodiment

Figure 8:
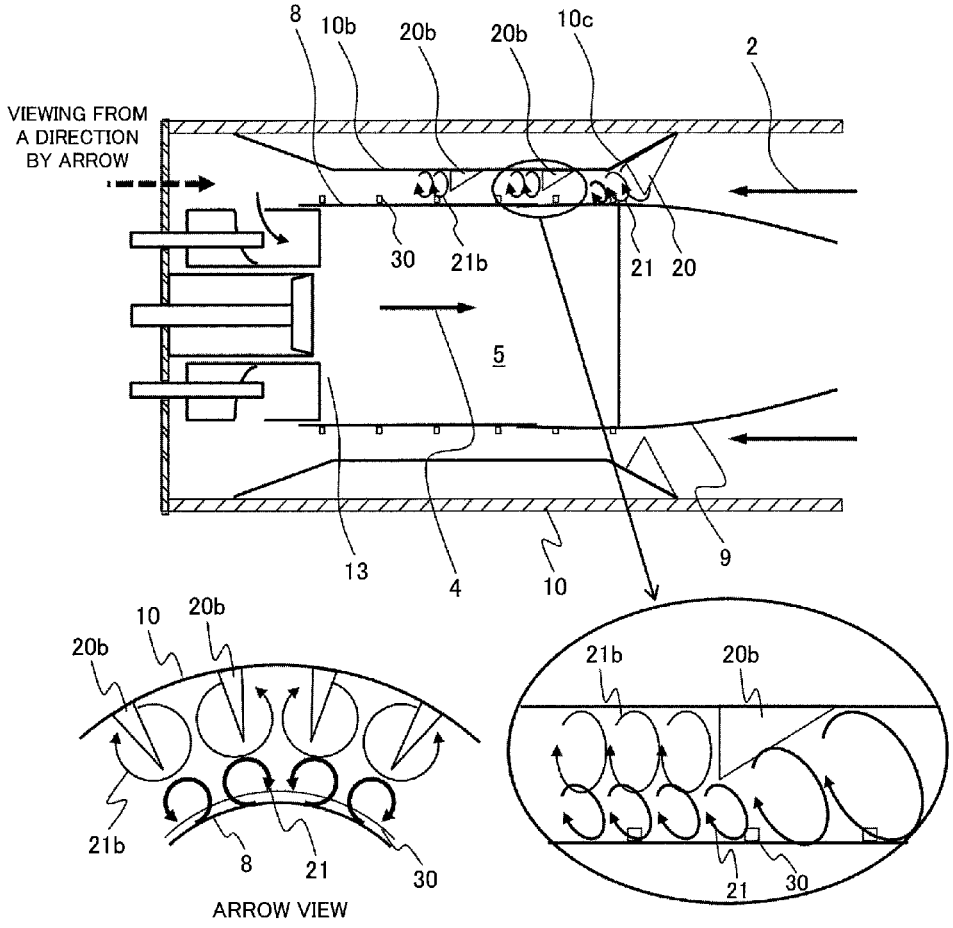
FIG. 8 is a sectional view of a gas turbine combustor according to a sixth embodiment of the present invention.

FIG. 8 is a view showing the structure of a combustor provided with a heat transfer device according to a sixth embodiment. Specifically, the outer tube is provided with longitudinal vortex generating means 20*b* on the inner surface of the inner diameter reduced portion 10*b* thereof. By this structure, a longitudinal vortex 21*b* which is produced by the longitudinal vortex generating means 20*b* agitates the cooling air 2 which flows in the annular flow passage 11. Moreover, by the effect of substantially narrowing the flow passage by the longitudinal vortex generating means 20*b* and the longitudinal vortex 21*b* produced thereby, the longitudinal vortex 21 which is produced by the longitudinal vortex generating means 20 on the upstream side is further pushed against the side of the combustor liner and the radius of the vortex is reduced to strengthen the vortex.

Therefore, the effect of agitating in the region more close to the liner surface that is the cooling target is induced and it is possible to promote the heat transfer while suppressing the increase of the pressure loss. In this case, if the directions of the vortexes are made in such a manner that the directions mutually become forward directions as shown by an arrow view of FIG. 8, it is possible to avoid vortex breakdown to enhance the vortexes, so that it is possible to widely improve the heat transfer promoting effect of the liner wall surface.

Moreover, the turbulence promoting means 30 are installed on the outer surface of the combustor liner 8, whereby the cooling promoting effect becomes synergistically large. This is because the separation vortex which is produced by the turbulence promoting means 30 destroys the boundary layer in the neighborhood of the combustor liner wall surface, whereby the cryogenic air which is conveyed from the side of the outer tube 10 by the longitudinal vortex can be effectively used for the cooling of the combustor liner 8.

Therefore, according to the structure of this embodiment in which the longitudinal vortex generating means 20*b* on the inner diameter reduced portion 1*ob* of the outer tube and the turbulence promoting means 30 on the outer surface of the combustor liner 8 are provided at the same time, the cooling efficiency can be more improved, so that the effect of more significantly improving the reliability of the product and the effect of suppressing the increase of the pressure loss can be obtained.

Incidentally, even in the structure in which the outer tube 10 includes the plurality of inner diameter reduced portions 10*b* as shown in FIG. 7, the structure of this embodiment is naturally applicable. In this case, the longitudinal vortex generating means 20*b* may be installed on the plurality of inner diameter reduced portions 10*b* or may be installed on any of the plurality of inner diameter reduced portions 10*b*.

Incidentally, the present invention is not limited to the above-mentioned embodiments and includes various modifications without departing from the gist of the present invention. For example, the present invention is not limited to the embodiments having all the explained structures and includes embodiments in which portions of the structures are deleted. Further, a part of configurations according to one embodiment can be added to, or replaced by those according to other embodiments.

Moreover, while only the case where the heat transfer target is the liner of the gas turbine combustor has been explained in the above-mentioned embodiments, the present invention can be applied to any object as long as the cooling medium (cooling air) such as air flows along the surface of the object, like the combustor liner. Further, while the case where the combustor liner that is the heat transfer target is cooled by the cooling medium (cooling air), the present invention can be applied to a case where the heat transfer target is heated by the cooling medium (cooling air).

Moreover, as the turbulence promoting means 30, there may be employed, for example, uneven-shaped portions other than the ribs extending in the circumferential direction of the combustor liner 8.

EXPLANATION OF REFERENCE SIGNS

1: Compressor
2: Combustion air
3: Turbine
4: Combustion gas
5: Combustion chamber
6: Combustor
7: Electricity generator
8: Combustor Liner
9: Transition piece
10: Outer tube
10*b*: Inner diameter reduced portion of outer tube
10*c*: Taper portion of outer tube
11: Annular flow passage
12: Plate
13: Burner
20: Longitudinal vortex generating means
21: Longitudinal vortex
22: Sheet material
30: Rib

What is claimed is:

1. A gas turbine combustor having a central axis and comprising:

a combustor liner defining a combustion chamber therein;

an outer tube surrounding the combustor liner; and an annular flow passage in which a cooling medium flows in a downstream direction, the annular flow passage being formed between an outer surface of the combustor liner and an inner surface of the outer tube, the annular flow passage having a height in a radial direction that varies along the axial direction and the outer tube having an inner radial diameter that varies along the axial direction, the outer tube comprising:

an inner peripheral portion, a taper portion joined to and downstream of the inner peripheral portion, and an inner diameter reduced portion joined to and downstream of the taper portion, wherein the inner radial diameter is a first diameter at the inner peripheral portion, the inner radial diameter is a second diameter smaller than the first diameter at the inner diameter reduced portion, the inner radial diameter changes continuously from the first diameter to the second diameter from an upstream end of the taper portion to a downstream end of the taper portion, the height is a first height at the inner peripheral portion, the height is a second height less than the first height at the inner diameter reduced portion, the height changes continuously from the first height to the second height from the upstream end to the downstream end, a longitudinal fin is provided directly on an inner surface of the outer tube on the upstream side relative to the inner diameter reduced portion, and the longitudinal fin generates a vortex that has a central rotation axis in the downstream direction.

2. The gas turbine combustor according to claim 1, wherein a plurality of turbulators which destroy a boundary layer produced in the cooling medium are arranged in an axial direction of the combustor liner on the outer surface of the combustor liner.

3. The gas turbine combustor according to claim 1, wherein the longitudinal fin is arranged on the taper portion.

4. The gas turbine combustor according to claim 3, wherein the outer tube includes a plurality of inner diameter reduced portions, and a plurality of taper portions each taper portion of the plurality of taper portions corresponding to a respective inner diameter reduced portion of the plurality of inner diameter reduced portions, and a plurality of longitudinal fins, wherein each longitudinal fin of the plurality of longitudinal fins is provided on a corresponding taper portion of the plurality of taper portions.

5. The gas turbine combustor according to claim 1, wherein the inner diameter reduced portion is provided with another longitudinal fin.

6. The gas turbine combustor according to claim 1, wherein the longitudinal fin has a height equal to a height of the annular flow passage.

7. The gas turbine combustor according to claim 1, wherein the longitudinal fin is configured by causing triangular ribs to be arranged so as to have an elevation angle with respect to the downstream direction.

8. The gas turbine combustor according to claim 1, wherein the longitudinal fin is mold-processed on a surface of a sheet material, and the sheet material is bend-machined in a cylindrical shape and inserted inside the outer tube.

9. The gas turbine combustor according to claim 4, wherein angles of the plurality of longitudinal fins relative to a primary flow direction are acute angles of 10 to 20 degrees.

* * * * *